US010876426B2

(12) United States Patent
Smith

(10) Patent No.: US 10,876,426 B2
(45) Date of Patent: Dec. 29, 2020

(54) REMOVABLE TURBINE GASPATH SENSOR

(71) Applicant: PRATT & WHITNEY CANADA CORP., Longueuil (CA)

(72) Inventor: Scott Smith, Saint-Lambert (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 50 days.

(21) Appl. No.: 16/406,405

(22) Filed: May 8, 2019

(65) Prior Publication Data

US 2020/0325794 A1 Oct. 15, 2020

Related U.S. Application Data

(60) Provisional application No. 62/831,346, filed on Apr. 9, 2019.

(51) Int. Cl.
*F01D 25/00* (2006.01)

(52) U.S. Cl.
CPC ..... *F01D 25/00* (2013.01)

(58) Field of Classification Search
None
See application file for complete search history.

(56) References Cited

U.S. PATENT DOCUMENTS 4,018,083 A 4/1977 Hoffman
4,244,221 A * 1/1981 Scott ..... F01D 17/08 324/755.01
4,392,345 A * 7/1983 Geary, Jr. ..... B01J 8/005 208/153
5,042,246 A * 8/1991 Moore ..... F01D 19/00 60/39.182
6,250,167 B1 * 6/2001 Peace ..... G01F 1/115 204/606
6,546,735 B1 * 4/2003 Moniz ..... F01D 9/065 415/118
6,843,061 B2 1/2005 Parker et al.
9,709,458 B1 * 7/2017 Garvin ..... G01M 3/38
9,880,059 B2 1/2018 Myers et al.
2009/0049894 A1 * 2/2009 Wilbraham ..... F23N 5/082 73/112.01
2010/0148760 A1 * 6/2010 Cox ..... G01P 3/44 324/177
2012/0023967 A1 2/2012 DeDe et al.
2012/0061559 A1 * 3/2012 Ortiz ..... G01V 5/10 250/254
2013/0195546 A1 * 8/2013 Ponziani ..... F23R 3/60 403/327
2014/0007589 A1 * 1/2014 Zimmermann ..... F01D 25/28 60/796
2014/0202253 A1 * 7/2014 Harpin ..... G02B 6/424 73/705

(Continued)

*Primary Examiner* — Michael Lebentritt
(74) *Attorney, Agent, or Firm* — Norton Rose Fulbright Canada LLP

(57) ABSTRACT

A gas turbine engine comprises a turbine within a turbine case defining a hot combustion gas path. The turbine case has an inner port. An outer case is disposed radially outward from the turbine case. The outer case has an outer port. A sleeve releasably engages the outer port and the inner port. A sensor is mounted to a distal end of the sleeve. The sensor has a probe extending through the inner port into the hot combustion gas path.

20 Claims, 5 Drawing Sheets

(56) References Cited

U.S. PATENT DOCUMENTS

| | | | | |
|---|---|---|---|---|
| 2014/0241854 | A1* | 8/2014 | Gekht | F01D 11/24 415/60 |
| 2014/0255147 | A1* | 9/2014 | Root | F01D 25/002 415/1 |
| 2015/0033757 | A1* | 2/2015 | White | F01D 17/02 60/783 |
| 2016/0265381 | A1* | 9/2016 | Vo | F01D 25/24 |
| 2020/0011247 | A1* | 1/2020 | Schwarz | F02C 3/04 |

* cited by examiner

REMOVABLE TURBINE GASPATH SENSOR

CROSS REFERENCE TO RELATED APPLICATIONS

The present application claims priority on U.S. Provisional Patent Application No. 62/831,346 filed on Apr. 9, 2019, the entire content of which is herein incorporated by reference.

TECHNICAL FIELD

The disclosure relates generally to gas turbine engines and, more particularly, to a turbine gaspath sensor mounting arrangement.

BACKGROUND

Turbine gaspath sensors are exposed to high temperature, vibration and combustion gases that may reduce the service life and can cause failure of the temperature sensor. The sensor may be mounted in a threaded bore within the turbine case. The high temperatures and combustion gases can cause the threaded connection to seize, corrode, accumulate contaminants or soot which can impede removal of the sensor for inspection and replacement. The seized mounting connection adds to the labour and downtime involved in removal and replacement of the temperature sensor. Improvement is desirable.

SUMMARY

In one aspect, the disclosure describes a gas turbine engine comprising: a turbine case circumscribing a gaspath, the turbine case having an inner port; an outer case radially outward from the turbine case, the outer case having an outer port; a sleeve releasably engaging the outer port and the inner port; and a sensor releasably mounted to a distal end of the sleeve, the sensor having a probe extending through the inner port into the gaspath In a further aspect, the disclosure describes a method of mounting a turbine gaspath sensor in a gas turbine engine having an outer case surrounding a turbine case, the outer case having a an outer boss defining an outer port, the turbine case defining an inner port, the method comprising: mounting the turbine gaspath sensor to a distal end of the sleeve; inserting the sleeve into the outer port and the inner port; and releasably securing the sleeve to the outer port by engaging a cap over the outer boss on an outer surface of the outer case.

In a still further aspect, there is provided a hot section of a gas turbine engine comprising: a turbine case circumscribing a gaspath, the turbine case having an inner port; an outer case radially outward from the turbine case, the outer case having a boss defining an outer port; a sleeve extending between the outer port and the inner port; a sensor mounted to a distal end of the sleeve, the sensor having a probe extending through the inner port into the gaspath; and a cap releasably engaged with the outer port.

Embodiments can include combinations of the above features. Further details of these and other aspects of the subject matter of this application will be apparent from the detailed description included below and the drawings.

DETAILED DESCRIPTION

Figure 1:
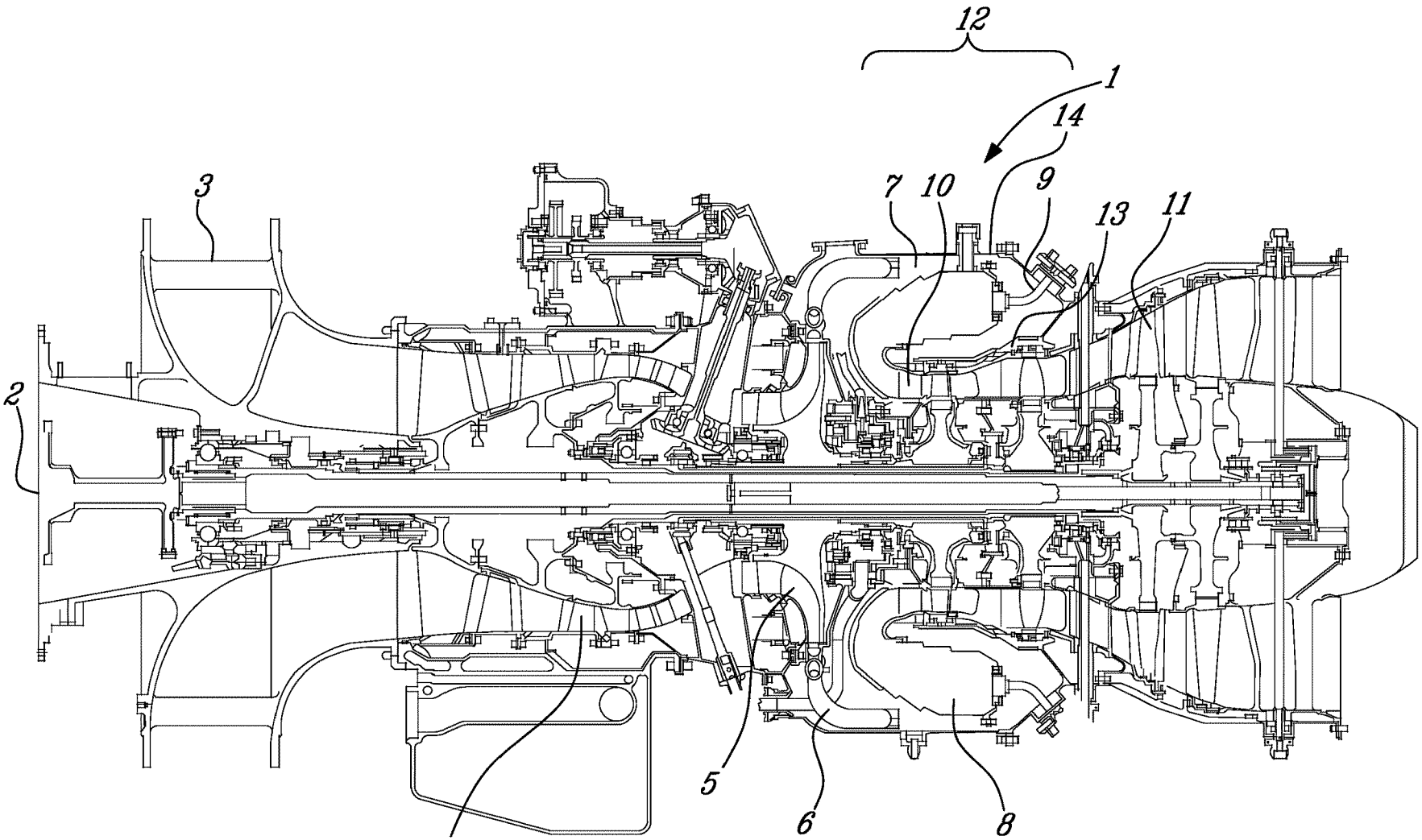
FIG. 1 shows an axial cross-section view of a turbo-shaft gas turbine engine.

FIG. 1 shows an axial cross-section through an example turbo-shaft gas turbine engine 1 with a power take off shaft 2. Air intake into the engine enters the intake duct 3 to the low-pressure axial compressor 4 and high-pressure centrifugal compressor 5. Compressed air exits the compressor 5 through a diffuser 6 and is contained within a plenum 7 that surrounds the combustor 8. Fuel is supplied to the combustor 8 through fuel tubes 9 and fuel is mixed with air from the plenum 7 when sprayed through nozzles into the combustor 8 as a fuel air mixture that is ignited. A portion of the compressed air within the plenum 7 is admitted into the combustor 8 through orifices in the side walls to create a cooling air curtain along the combustor walls or is used for cooling to eventually mix with the hot gases from the combustor and pass over the nozzle guide vane 10 and turbines 11 before exiting the tail of the engine as exhaust.

With reference to FIG. 1, the present description and drawings relate to the hot section 12 of the engine 1, namely the turbines 11 contained within a turbine case 13 and the combustor 8 inward of an outer case 14. In particular, as shown in FIG. 2, a turbine gaspath sensor (e.g. a temperature sensor) 15 is mounted within a removable sleeve 16 permitting access to the sensor 15 from an outer port in the outer case 14 for removal, inspection and cooling of the sensor 15.

Figure 2:
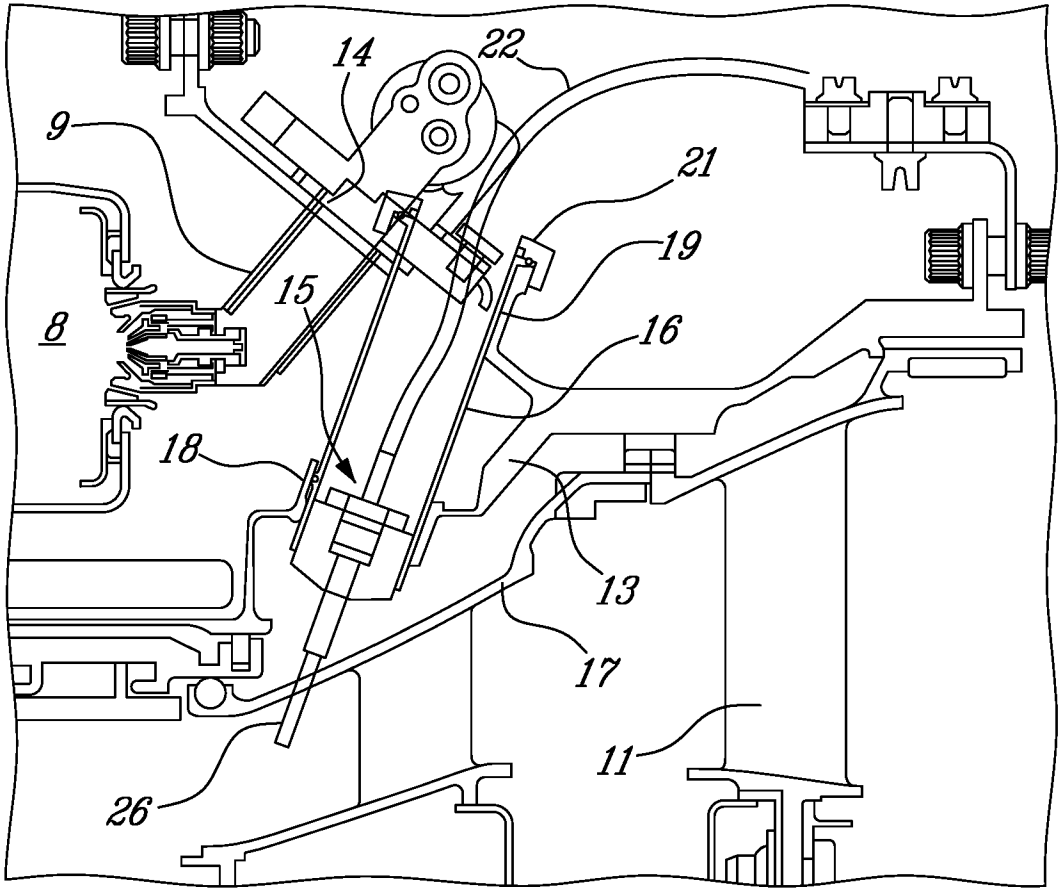
FIG. 2 is a partial axial cross-sectional view of a sleeve, passing through an outer port in the outer case and through an inner port in the turbine case, and a temperature sensor mounted to the distal end of the sleeve with a sensor probe extending into the hot gaspath.
Figure 3:
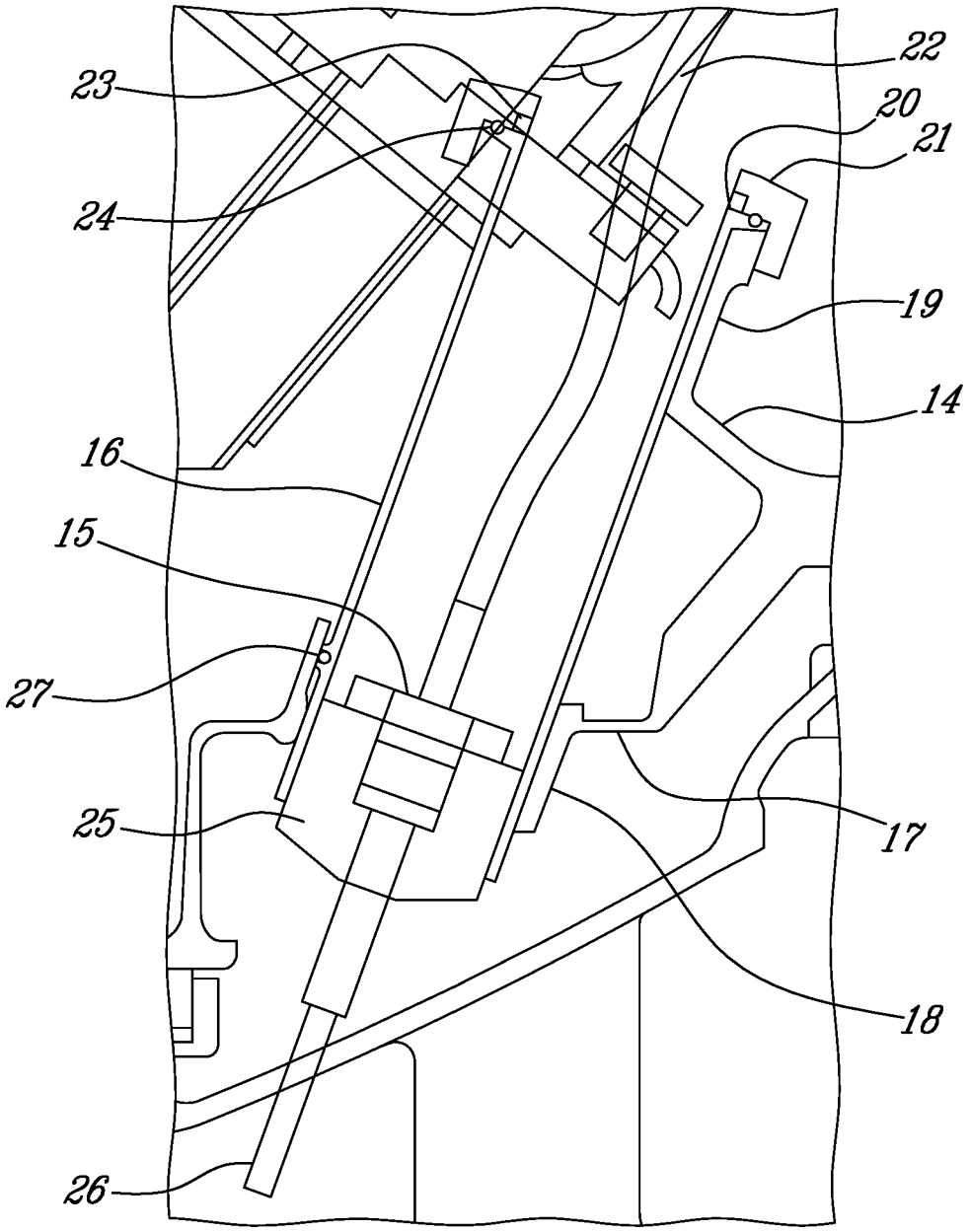
FIG. 3 is a detail axial cross-section of the sleeve of FIG. 2.

Referring to FIGS. 2 and 3, the turbine 11 is housed within the turbine case 13. The turbines 11 include a shroud 17 defining a hot combustion gas path. The turbine case 13 has inner port formed in the center of an annular boss 18 having an interior surface mating the proximal end of the sleeve 16.

The outer case 14 is radially outward from the turbine case 13. The outer case 14 has an outer port formed in the center of an annular boss 19 having an interior surface mating the distal end of the sleeve 16.

As best seen in the detail view of FIG. 3, the proximal end of the sleeve 16 has an annular flange 20 to seat the sleeve 16 into the annular boss 19. The proximal end of the sleeve 16 has an exterior surface mounted and secured within the outer port the annular boss 19 with a releasable connector such as a cap ring 21. The cap ring 21 joins the annular flange 20 of the sleeve 16 and the annular boss 19 surrounding the outer port, for example using a threaded connection.

The cap ring 21 has a central aperture through which the electrical lead 22 of the sensor 15 can pass. The large central aperture and large internal diameter of the sleeve 16 permits cooling air to be conveyed and to circulate within the sleeve 16 from outward of the outer case 14 to cool the sensor 15 and electrical lead 22. Turbulent air flow in the engine outward of the outer case 14 is sufficient for cooling air and mechanical fans or flow diverters are not necessary.

To prevent undesirable cool air leakage into the hot section, an annular seal 23 may be disposed between the annular flange 20 of the sleeve 16 and the annular boss 19 around the outer port. Further an annular seal 24 may be disposed between the annular flange 20 of the sleeve 16 and the cap ring 21. The annular seals 23, 24 can be metal piston rings, crushable seals, or split ring seals for example which are compressed when the cap ring 21 is threaded and torqued onto the annular boss 19.

The sleeve 16 is releasably engaged at a proximal end to the annular boss 19 about the outer port using the threaded cap ring 21 and is slidably engaged at the distal end within the inner port of the annular boss 18 in the turbine cas 13. The turbine sensor 15 is releasably mounted to the distal end of the sleeve 16 using an annular ferrule 25 with a threaded connection or is press fit. The sensor 15 has an end probe 26 extending through the inner port into the hot combustion gas path (see FIG. 2).

The distal end of the sleeve 16 has an exterior surface slidingly mounted within the inner port of the annular boss 18 in the turbine case 13. The distal end of the sleeve 16 may include an annular seal 27 disposed between the exterior surface of the distal end and the inner port of the annular boss 18. The annular seal 27 impedes the escape of hot combustion gas from within the turbine case 13. To facilitate insertion and compression of the annular seal 27, the exterior surface of the distal end of the sleeve 16 is chamfered and the annular boss 18 has a tapered interior surface mating the chamfered exterior surface of the sleeve 16.

Figure 4:
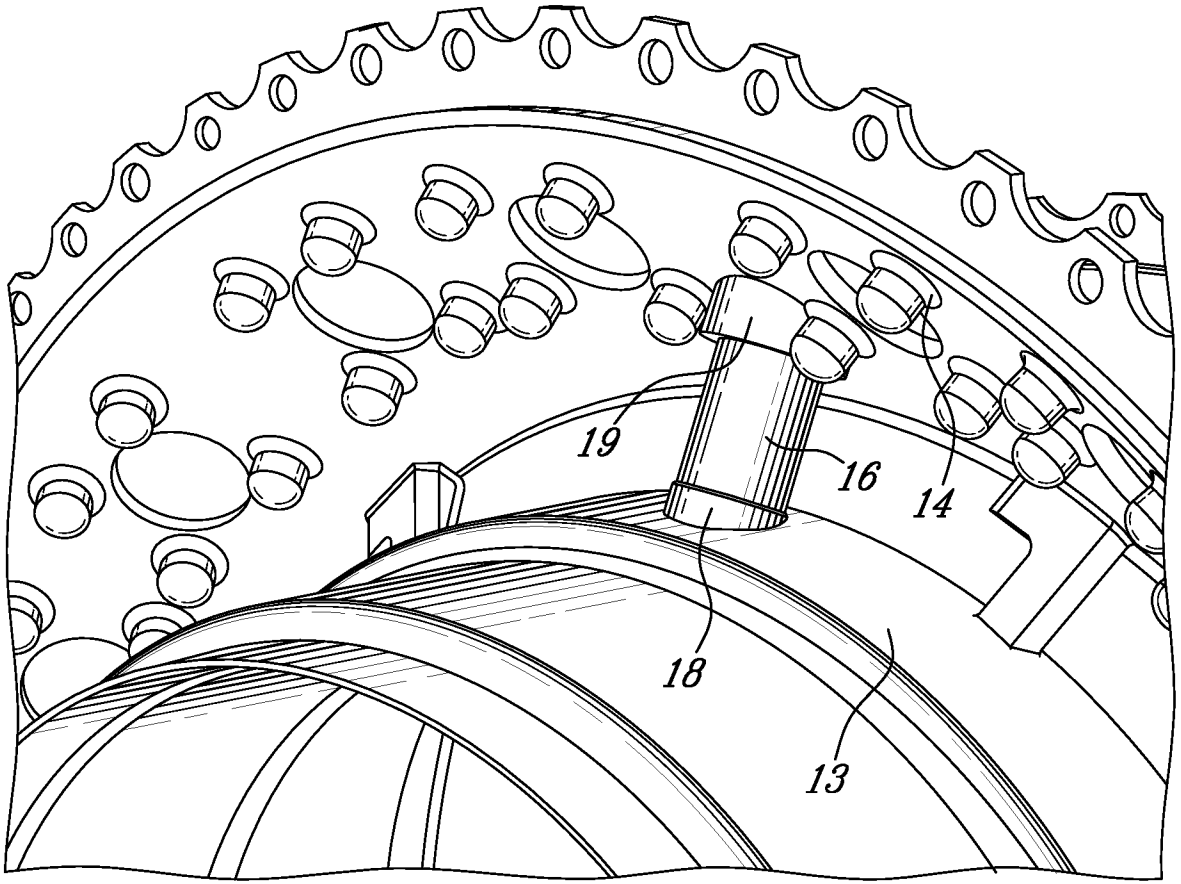
FIG. 4 is a partial isometric view of the outer case and turbine case with the sleeve extending therebetween.
Figure 5:
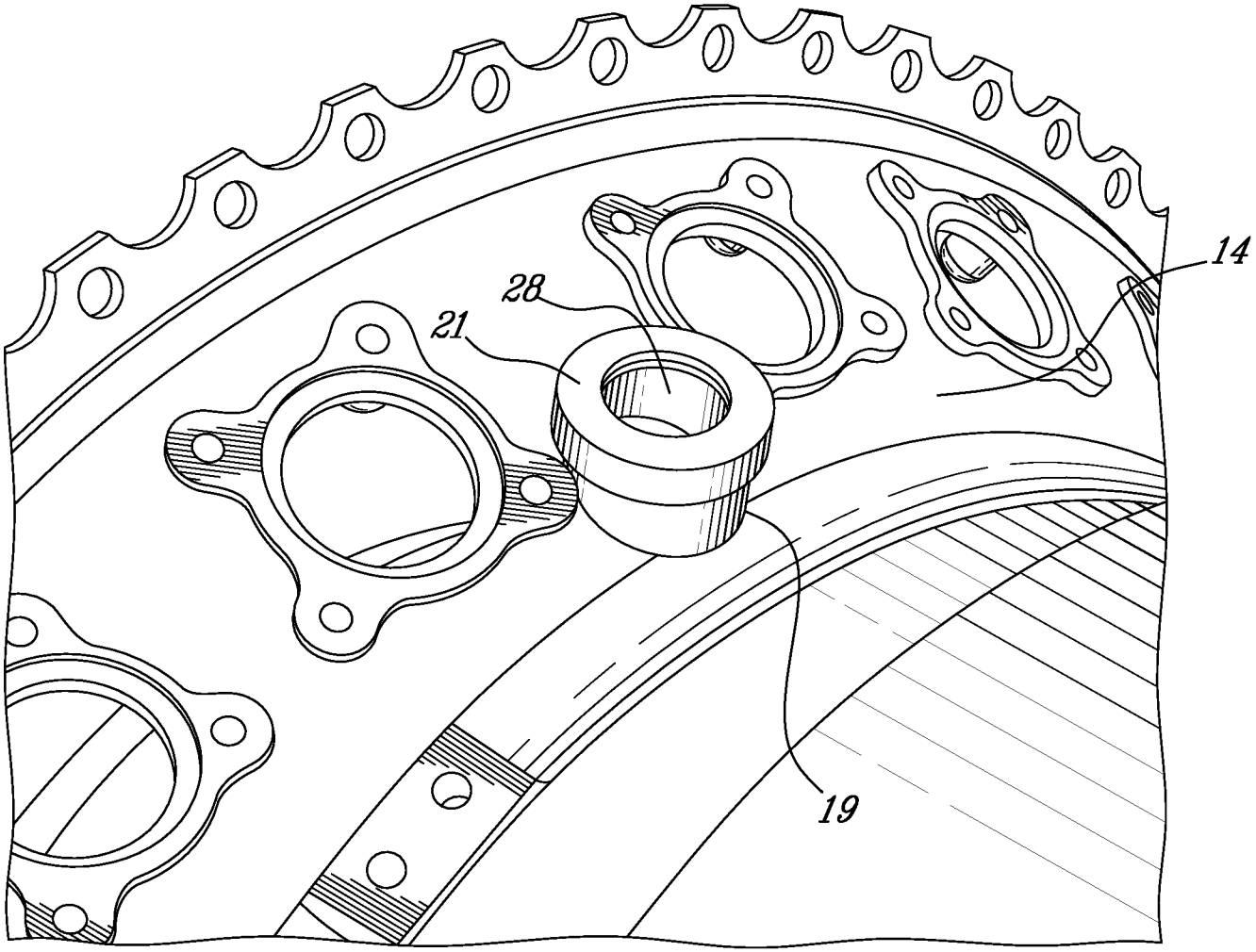
FIG. 5 is a partial isometric view of an annular boss in the outer case for mounting the flanged distal end of the sleeve secured with an annular cap ring.

FIGS. 4 and 5 show isometric views of the outer case 14. FIG. 4 shows the turbine case 13 radially inward of the outer case 14. The sleeve 16 extends between the annular boss 19 in the outer case 14 to the annular boss 18 in the turbine case 13. When the sleeve 16 is removed, the annular bosses 18, 19 provide access for a boroscope or other tools to inspect and maintain the interior of the engine. FIG. 4 shows the outer case 14, the annular boss 19 and cap ring 21. The large diameter of the central aperture 28 and large internal diameter of the sleeve 16 permits cooler air to be conveyed within the sleeve 16 from outward of the outer case 14 which reduces thermal stress on the sensor 15 and electrical lead 22.

Referring back to FIG. 3, the sensor 15 can be accessed through the sleeve 16 for removal using a socket wrench to disengage the externally threaded sensor 15 from the internally threaded ferrule 25. However if the ferrule 25 and sensor 15 are seized together, or if a more complete inspection is required, the entire sleeve 16 can be removed with the sensor 15 by disengaging the cap ring 21 from the annular boss 19. The sleeve 16 can be withdrawn along its axis to disengage from the annular boss 18 in the turbine case 13 by sliding since the chamfered external surface and annular seal 27 are press fit in place.

The sleeve 16 described above and shown in the drawings provides a reliable method of inspecting or replacing the sensor 15, providing cooling air ventilation to the sensor 15 and accessing internal sections of the engine through the annular bosses 18, 19. If the sensor 15 is seized to the ferrule 25 or otherwise to the distal end of the sleeve 16, removal of the entire sleeve 16 is accomplished by removing the cap ring 21. Rapid inspection and replacement of the sensor 15 is enabled by mounting the sensor 15 at the distal end of the removable sleeve 16.

The above description is meant to be exemplary only, and one skilled in the relevant arts will recognize that changes may be made to the embodiments described without departing from the scope of the invention disclosed. The present disclosure may be embodied in other specific forms without departing from the subject matter of the claims. The present disclosure is intended to cover and embrace all suitable changes in technology. Modifications which fall within the scope of the present invention will be apparent to those skilled in the art, in light of a review of this disclosure, and such modifications are intended to fall within the appended claims. Also, the scope of the claims should not be limited by the preferred embodiments set forth in the examples, but should be given the broadest interpretation consistent with the description as a whole.

What is claimed is:

1. A gas turbine engine comprising:

a turbine case circumscribing a gaspath, the turbine case having an inner port;

an outer case radially outward from the turbine case, the outer case having an outer port;

a sleeve releasably engaging the outer port and the inner port; and a sensor releasably mounted to a distal end of the sleeve, the sensor having a probe extending through the inner port into the gaspath.

2. The gas turbine engine according to claim 1 wherein the distal end of the sleeve has an exterior surface slidingly mounted within the inner port.

3. The gas turbine engine according to claim 2 wherein the distal end of the sleeve has an annular seal disposed between the exterior surface and the inner port.

4. The gas turbine engine according to claim 2 wherein the exterior surface of the distal end of the sleeve is chamfered.

5. The gas turbine engine according to claim 4 wherein the inner port comprises an annular boss having an interior surface mating the chamfered exterior surface.

6. The gas turbine engine according to claim 1 wherein the sensor is releasably mounted to an interior ferrule disposed within the distal end of the sleeve.

7. The gas turbine engine according to claim 6 wherein the sensor is releasably mounted to the interior ferrule with a threaded connection.

8. The gas turbine engine according to claim 1 wherein a proximal end of the sleeve has an exterior surface mounted within the outer port with a releasable connector.

9. The gas turbine engine according to claim 8 wherein the outer port comprises an annular boss having an interior surface mating the proximal end of the sleeve.

10. The gas turbine engine according to claim 8 wherein the proximal end of the sleeve includes an annular flange.

11. The gas turbine engine according to claim 10 wherein the releasable connector comprises a cap ring engaging the annular flange of the sleeve and the annular boss of the outer port, the cap ring having a central aperture.

12. The gas turbine engine according to claim 11 including an annular seal disposed between the annular flange of the sleeve and the annular boss of the outer port.

13. The gas turbine engine according to claim 11 wherein the cap ring and annular boss of the outer port are joined in a threaded connection.

14. A method of mounting a turbine gaspath sensor in a gas turbine engine having an outer case surrounding a turbine case, the outer case having a an outer boss defining an outer port, the turbine case defining an inner port, the method comprising:

mounting the turbine gaspath sensor to a distal end of the sleeve;

inserting the sleeve into the outer port and the inner port; and releasably securing the sleeve to the outer port by engaging a cap over the outer boss on an outer surface of the outer case.

15. The method of claim 14, wherein releasably securing comprises engaging an annular flange at a proximal end of the sleeve with the outer boss, and threadably engaging the cap with the outer boss.

16. The method of claim 14, wherein mounting the turbine gaspath sensor comprises releasably connecting the turbine gaspath sensor with the distal end of the sleeve.

17. A hot section of a gas turbine engine comprising:

a turbine case circumscribing a gaspath, the turbine case having an inner port;

an outer case radially outward from the turbine case, the outer case having a boss defining an outer port;

a sleeve extending between the outer port and the inner port;

a sensor mounted to a distal end of the sleeve, the sensor having a probe extending through the inner port into the gaspath; and a cap releasably engaged with the outer port.

18. The hot section according to claim 17, wherein the cap comprises a cap ring engaging an annular flange of the sleeve and the boss, the cap ring having a central aperture in fluid communication with atmosphere outside the outer case.

19. The hot section according to claim 18 including an annular seal disposed between the annular flange of the sleeve and the boss.

20. The gas turbine engine according to claim 18 wherein the cap ring and the boss are joined in a threaded connection.

* * * * *